US007189166B2

(12) United States Patent
Paré

(10) Patent No.: US 7,189,166 B2
(45) Date of Patent: Mar. 13, 2007

(54) GOLFING ACCESSORY

(76) Inventor: Jean-Guy Paré, 8240, 59th Avenue, Laval, Quebec (CA) H7R 4G8

( * ) Notice: Subject to any disclaimer, the term of this patent is extended or adjusted under 35 U.S.C. 154(b) by 0 days.

(21) Appl. No.: 11/081,557

(22) Filed: Mar. 17, 2005

(65) Prior Publication Data

US 2005/0288122 A1 Dec. 29, 2005

(30) Foreign Application Priority Data

Jun. 23, 2004 (CA) ..... 2471030

(51) Int. Cl.
*A63B 55/10* (2006.01)
*A63B 57/00* (2006.01)

(52) U.S. Cl. ..... 473/282; 473/406; 473/408; 172/378; 248/520; 248/176.1

(58) Field of Classification Search ..... 473/406–408, 473/282–283, 285–286; 172/378; D21/793–794, D21/796; D6/552; 211/70.2, 70.8; 248/316.4–316.7, 248/520, 176.1, 530, 533
See application file for complete search history.

(56) References Cited

U.S. PATENT DOCUMENTS

| | | | |
|---|---|---|---|
| 4,210,334 | A | 7/1980 | Lind |
| 4,627,621 | A | 12/1986 | Tate |
| 4,998,726 | A | 3/1991 | Budnick |
| 5,116,046 | A | 5/1992 | Pace |
| 5,152,524 | A | 10/1992 | Brown |
| 5,226,647 | A | 7/1993 | Notarmuzi |
| 5,230,507 | A | 7/1993 | White et al. |
| 5,285,990 | A | 2/1994 | Engel |
| 5,305,999 | A | 4/1994 | Tate |
| 5,419,551 | A | 5/1995 | Hoyt et al. |
| 5,467,980 | A | 11/1995 | Weisenstein |
| 5,562,553 | A | 10/1996 | Digerness et al. |
| 5,769,740 | A | 6/1998 | Colangelo |
| 5,890,970 | A | 4/1999 | Donati |
| 6,022,280 | A | 2/2000 | Arenburg et al. |
| 6,162,137 | A | 12/2000 | Jones et al. |
| 6,315,133 | B1 | 11/2001 | Franke |
| 6,413,174 | B1 | 7/2002 | Roberts |

FOREIGN PATENT DOCUMENTS

| | | | |
|---|---|---|---|
| CA | 2208544 | A1 | 7/1997 |
| CA | 2293073 | A1 | 12/1999 |

*Primary Examiner*—Stephen Blau

(57) ABSTRACT

A golfing accessory for supporting a golf club away from a ground surface. The golf club has a shaft. The accessory includes a substantially elongated body defining a body first end and a substantially longitudinally opposed body second end. The body is provided with a shaft receiving recess for receiving at least partially therein the shaft, the recess being provided substantially adjacent the body first end. A ground engaging member is pivotably attached to the body substantially adjacent to the body second end for pivotal movement between a retracted configuration and an extended configuration. The ground engaging member defines a member distal tip for insertion at least in part into the ground. In the retracted configuration, the member distal tip is substantially in register with the body, and in the extended configuration, the member distal tip extends substantially outwardly from the body.

19 Claims, 3 Drawing Sheets

GOLFING ACCESSORY

This Application claims priority from Canadian Patent Application Serial Number 2,471,030 filed Jun. 23, 2004.

FIELD OF THE INVENTION

The present invention relates to the field of golfing, and is more particularly concerned with a golfing accessory.

BACKGROUND OF THE INVENTION

While the game of golf is mainly concerned with hitting a ball with a golf club, golfers typically use accessories, tools or other implements while practicing this sport.

For example, U.S. Pat. No. 5,116,046 issued on May 26, 1992 to Pace describes a multipurpose golfer's tool. This tool is removably attachable to the shaft of a golf club. The tool includes a top section containing two curved resilient legs and a bottom section containing two wedge shaped legs. The two sections lie substantially in the same plane and the bottom section is longer than the top section. The resilient legs of the top section each define a substantially circular arch, which extends at least 210°.

A first use for the above-described tool includes supporting a golf club away from a ground surface. To that effect, the shaft of the golf club is inserted between the resilient legs and the wedge shaped legs are inserted into the ground.

Another use for the above-described tool includes cleaning the sole of a golf shoe using the wedge shaped legs. Another use includes repairing ball marks on a green by inserting the wedge shaped legs into a divot that has been produced by the golfer hitting the ground surface with the golf club so as to allow a user to position the divot.

While the above-described tool allows a golfer to perform more than one task using a single tool, many other tasks performed during the game of golf by at least some golfers cannot be performed with this tool. For example, there is sometimes a need to mark a location from which a ball is removed during play. Also, some golfers like to have a device to help them remember the number of shots that have been performed during play. Also, some golfers like to have a tool to use as a sight to indicate the general direction into which the golf ball is to be hit.

In addition, the above described tool has relatively pointed legs that may eventually damage clothing if put into a pocket by the golfer. Furthermore, the material chosen to manufacture the above described tool is thermal plastic and as such is relatively fragile as compared to other materials.

In view of the above, there exists a need in the industry to provide a novel multipurpose golf accessory.

The present description refers to a number of documents, the content of which is herein incorporated by reference in their entirety.

OBJECTS OF THE INVENTION

An object of the present invention is therefore to provide an improved golfing accessory.

SUMMARY OF THE INVENTION

In a first broad aspect, the invention provides a golfing accessory for supporting a golf club away from a ground surface. The golf club has a shaft. The accessory includes a substantially elongated body defining a body first end and a substantially longitudinally opposed body second end. The body is provided with a shaft receiving recess for receiving at least partially therein the shaft, the recess being provided substantially adjacent the body first end. A ground engaging member is pivotably attached to the body substantially adjacent to the body second end for pivotal movement between a retracted configuration and an extended configuration. The ground engaging member defines a member distal tip for insertion at least in part into the ground. In the retracted configuration, the member distal tip is substantially in register with the body, and in the extended configuration, the member distal tip extends substantially outwardly from the body.

Advantageously, in the retracted configuration, the distal tip does not extend from the body and therefore is protected by the body so as to reduce the possibility of damages that may occur to fabric, or any other material, that may come in contact with the distal tip.

In the extended configuration, the member distal tip is insertable, at least in part, into a ground surface. Then, if the shaft of the golf club is received into the shaft receiving recess, suitably positioning the golf club and the accessory allow supporting the golf club grip away from the ground surface.

Such a ground surface may be wet or may have come into contact with pesticides or any other potentially toxic substances. Therefore, the accessory helps in spacing the grip away from these toxic substances, which helps in reducing an exposure of a golfer to these substances that may occur for example through the golfer scratching its skin, eyes or mouth, among other body parts, further to using the golf club. In addition, wet golf club grips are potentially slippery and as such require that the golfer grips the golf club grip with a relatively non-optimal force.

The golfing accessory is a multipurpose accessory and therefore provides a multitude of functionalities into a relatively small, relatively light, relatively inexpensive and relatively easy to manufacture implement. Furthermore, the golfing accessory is relatively ergonomic and does not require sophisticated skills in order to be used.

Advantageously, the ground engaging member is also usable for cleaning golf shoes or to repair ball marks on the green. Also, this member is usable to clean golf clubs.

In some embodiments of the invention, the shaft receiving recess is formed by substantially resilient arcuate legs. In these embodiments, the golf club shaft is insertable into the recess so as to frictionally engage the arcuate arms. Therefore, it is likely that when a user picks up a golf club that is supported by the golfing accessory, the golfing accessory will remain attached to the golf club shaft and therefore help in preventing the loss of the golfing accessory.

In some embodiments of the invention, a marker and a counter are provided. The marker allows the marking of the position of a ball that is removed from the ground. The counter allows for the counting of the number of shots required, for example, to get the golf ball into the hole.

In yet other embodiments of the invention, an arrow is provided so that the arrow and an opening leading into the recess help in allowing the user to sight a direction into which the golf ball is to be hit.

In some embodiments of the invention, a marker is used to convey a message, such as an advertisement, to users of the golfing accessory. In addition, in some embodiments of the invention, a label is secured to the body and includes any suitable information, such as for example advertising, or information regarding the game of golf.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
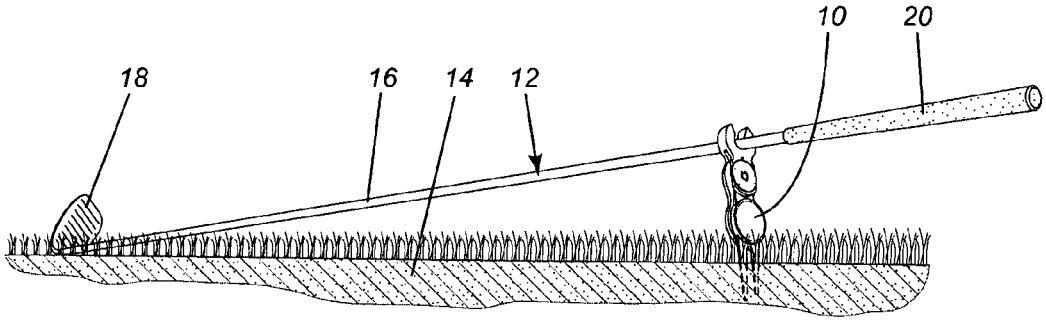
FIG. 1 illustrates in a perspective view a golf club supported by a golfing accessory according to the invention.

FIG. 1 illustrates a golfing accessory 10 for supporting a golf club 12 away from a ground surface 14. The golf club includes a shaft 16, a head 18 extending from the shaft 16 and a grip 20 secured to the shaft 16 at a location substantially longitudinally opposed to the head 18.

In a specific embodiment of the invention, the shaft 16 and the grip 20 are supported substantially away from the ground surface 14, while the head 18 abuts the ground surface 14. However, it is within the scope of the invention to support the golf club 12 in any other suitable manner.

Figure 2:
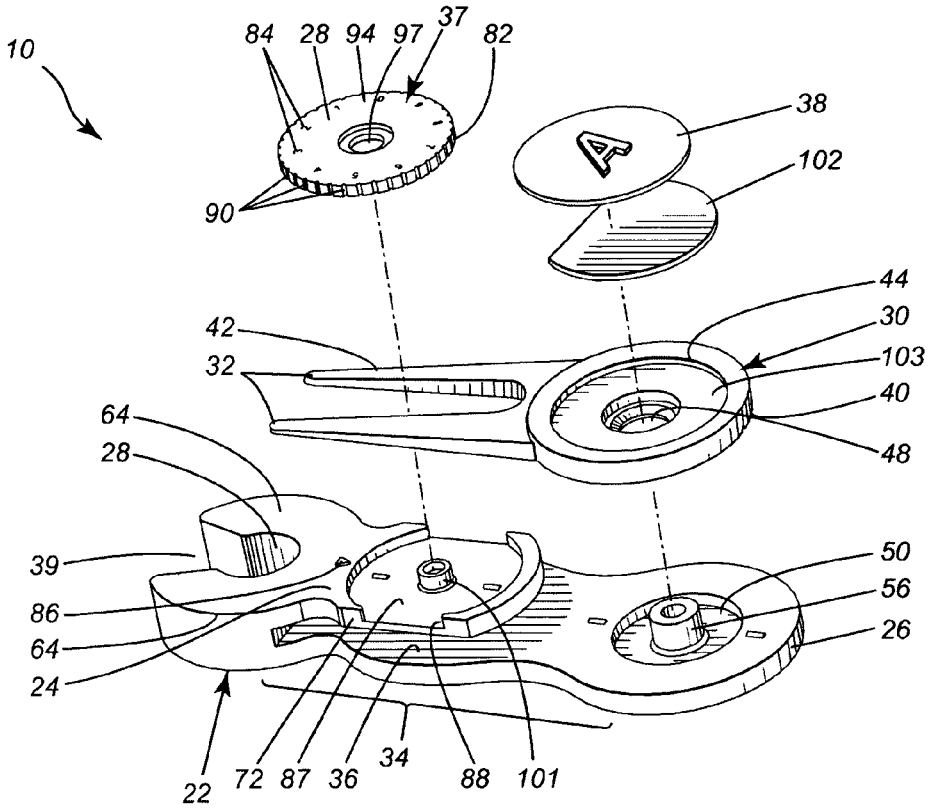
FIG. 2 illustrates in a perspective top exploded view the golfing accessory of FIG. 1.
Figure 3:
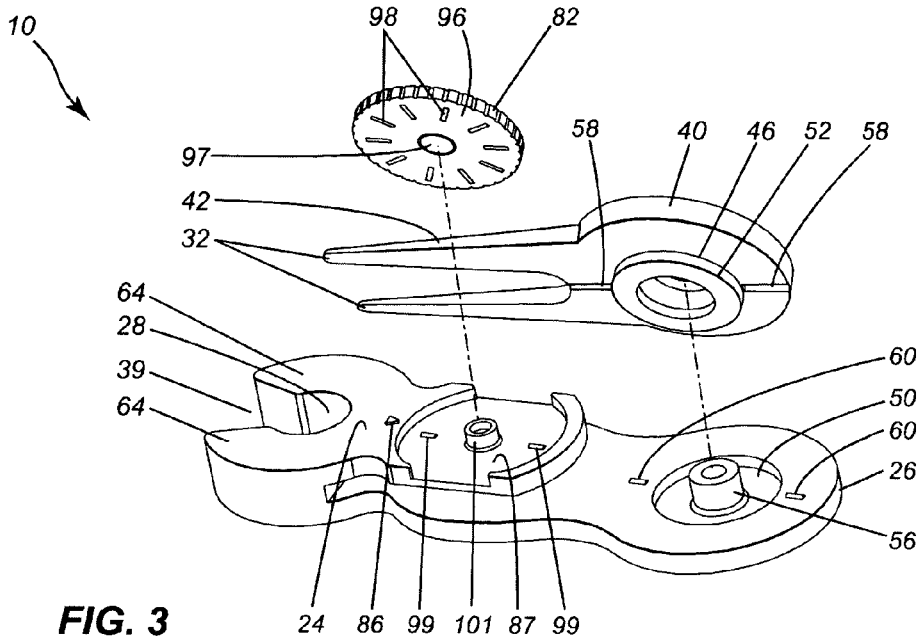
FIG. 3 illustrates in an alternative perspective exploded view, the golfing accessory of FIG. 1.

As better seen in FIGS. 2 and 3, the accessory 10 includes a substantially elongated body 22 defining a body first end 24 and a body second end 26. The body second end 26 is substantially longitudinally opposed to the body first end 24.

The body 22 is provided with a shaft receiving recess 28 (better seen in FIG. 7) for receiving at least partially therein the shaft 16. The shaft receiving recess 28 is provided substantially adjacent to the body first end 24. A ground engaging member 30 is pivotably attached to the body 22 substantially adjacent to the body second end 26. The ground engaging member 30 is attached for pivotal movement between a retracted configuration (shown in FIG. 5) and an extended configuration (shown in FIG. 4). The ground engaging member 30 defines a member distal tip 32 for insertion, at least in part, into the ground.

Figure 4:
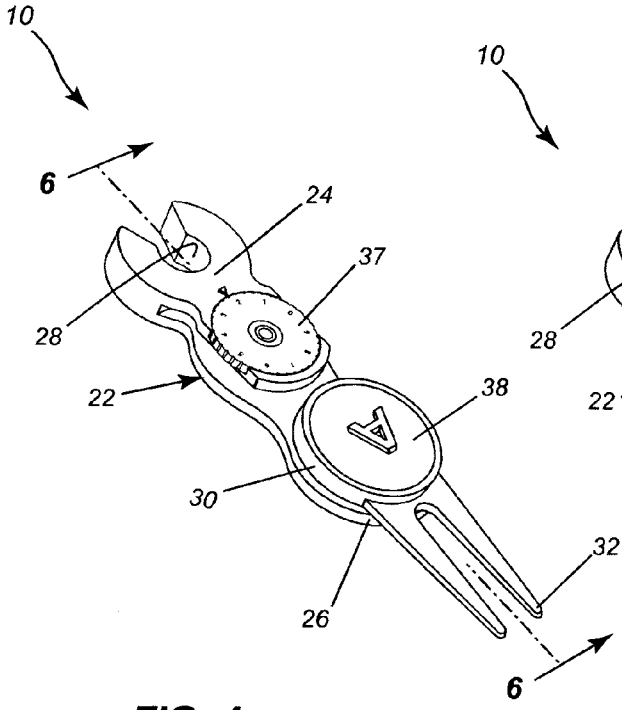
FIG. 4 illustrates in a perspective view, the golfing accessory of FIG. 1 with a ground engaging member in an extended configuration.
Figure 5:
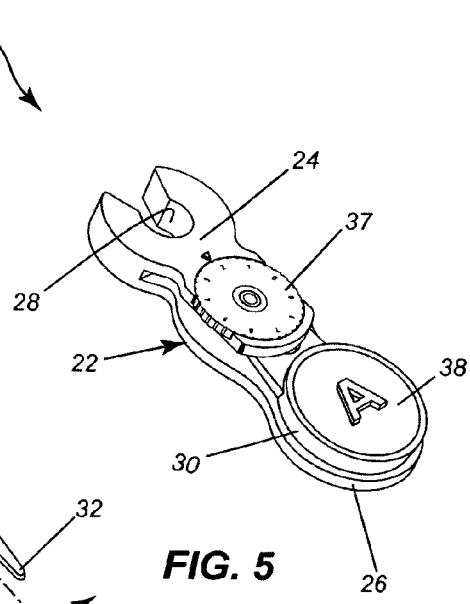
FIG. 5 illustrates in a perspective view, the golfing accessory of FIG. 1 with a ground engaging member in an retracted configuration.

As shown in FIG. 5, in the retracted configuration, the member distal tip 32 (not visible in FIG. 5) is substantially in register with the body 22. In the extended configuration, as shown in FIG. 4), the member distal tip 32 extends substantially outwardly from the body 22.

In some embodiments of the invention, when the member distal tip 32 is substantially in register with the body 22, the member distal tip 32 extends substantially towards the body first end 24. In this case, the body 22 substantially interferes with an action of the distal tip 32 that would engage an object external to the accessory 10. For example, the body 22 interferes with an engagement of the member distal tip 32 with a fabric forming a pocket in the clothes of a golfer.

In the extended configuration, the ground engaging member allows to perform a plurality of actions. For example, the ground engaging member 30 allows supporting the golf club 12 away from the ground surface 14. Also, in some embodiments of the invention, the ground engaging member 30 allows to clean the sole of a golf shoe, to clean the golf club shaft 16 and the golf club golf head 18, or to repair ball marks on the green. Such actions performed by ground engaging members and distal tips are well known in the art and will therefore not be described in further details.

Figure 6:
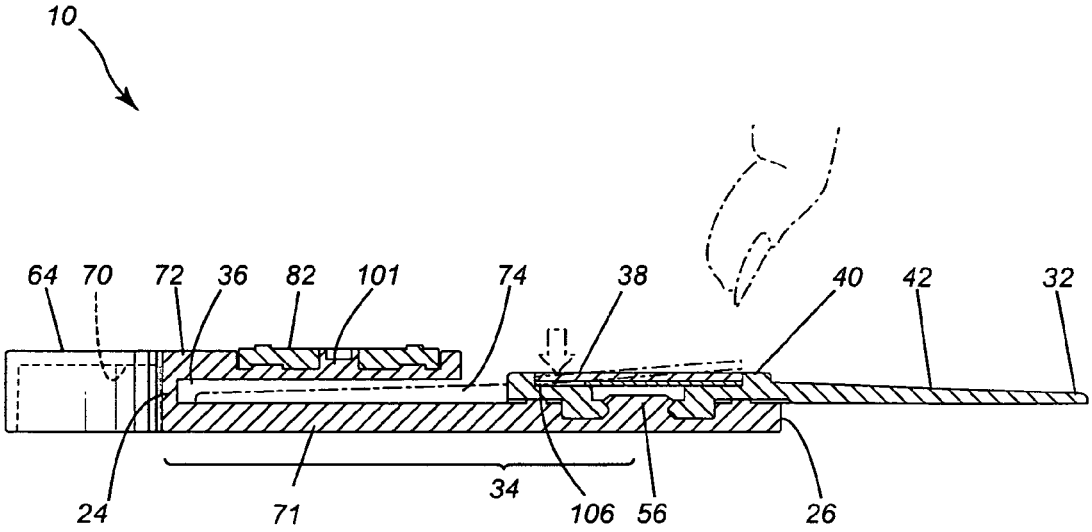
FIG. 6 is a cross sectional view of the golfing accessory of FIG. 1 taken along the line 6–6 of FIG. 4.

As better shown in FIG. 6, in some embodiments of the invention, the body 22 includes a body intermediate portion 34 provided between the body first end 24 and the body second end 26. The body intermediate portion 34 defines a pocket 36 for receiving, at least in part, thereinto the member distal tip 32 when the ground engaging member 32 is in the retracted configuration. However, in other embodiments of the invention, the body intermediate portion does not define a pocket. Also, while a specific pocket is illustrated in the drawings and described hereinbelow, it is within the scope of the claimed invention to have bodies including any other suitable pocket.

As seen in FIG. 2, in some embodiments of the invention, the accessory 10 further includes a counter 37, a marker 38, an opening 39 allowing screwing and unscrewing of spikes into the soul of a golf shoe, a label containing information relating to the game of golf (not shown in the drawings), and any other suitable components. In some embodiments of the invention, only some of the above-mentioned components are present, or even none of the above described components are included. Also, it is within the scope of the invention to have golfing accessory including any other suitable components. The above-described components are further described hereinbelow.

The ground engaging member 30 includes an attachment portion 40 and a fork 42 extending from the attachment portion 40. The member distal tip 32 is defined at an end of the fork 42 substantially opposite the attachment member 40. The exact shape of the fork 42 is not critical to the claimed invention and many shapes will be readily apparent to the reader skilled in the art.

The attachment portion 40 is substantially disc shaped and defines an attachment portion top surface 44 and a substantially opposed attachment portion bottom surface 46 (better shown in FIG. 3). The attachment portion 40 also defines a substantially central attachment portion aperture 48 extending from the attachment top surface 44 to the attachment portion bottom surface 46.

The body 22 defines a substantially annular attachment portion receiving recess 50 substantially adjacent to the body second end 26. The attachment portion bottom surface 46 defines a substantially annular ridge 52 (shown in FIG. 3) extending substantially downwardly there from. The annular ridge 52 is for engaging the attachment portion receiving recess 50.

The attachment portion 40 is attached to the body 22 through a rivet 56 extending integrally from the attachment portion receiving recess 50. The rivet 56 extends through the attachment portion aperture 48.

In some embodiments of the invention, the attachment portion 40 includes a releasable lock for releasably locking the ground engaging member into the extended configuration. Also, in some embodiments of the invention, the attachment portion 40 also includes a releasable lock for releasably locking the attachment portion with respect to the body 22 in the retracted configuration.

The releasable lock only allows pivotal movement of the ground engaging member with respect to the body 22 upon exertion of a predetermined torque between the body 22 and the ground engaging member 30.

A specific example of a releasable lock includes protrusions extending from the body 22 that engage recesses extending into the attachment portion 30. An engagement of the protrusions into the recesses allows releasable locking of the attachment portion 30.

For example, the attachment portion bottom body surface 46 defines an attachment portion recess 58 extending substantially inwardly thereinto. The body 22 defines a body protrusion 60 extending substantially upwardly therefrom for engaging an attachment portion recess 58. Upon the attachment portion receiving recess protrusion engaging the attachment portion recess, a rotation of the attachment portion with respect to the body 22 is allowed only upon a predetermined torque being exerted onto either one of the attachment member 30 and the body 22. Although a specific releasable lock is described hereinabove, it is within the scope of the invention to have any other suitable releasable lock.

The shaft receiving recess 28 is defined by first and second arms 64 extending substantially longitudinally outwardly from the body 22. The first and second arms 64 define the opening 39 therebetween that leads into the shaft receiving recess 28.

In some embodiments of the invention, the opening 39 is substantially tapered towards the shaft receiving recess 28. For example, the opening is configured and sized so as to be able to engage a golf shoe spike, thereby allowing an intended user to screw and unscrew the spike into or out from the shoe. Accordingly, in this case, the accessory 10 acts as a wrench allowing the intended user to screw and unscrew the spike. However, it is within the scope of the invention to have openings having any other suitable shape.

In some embodiments of the invention, the recess 28 is substantially cylindrical and dimensioned so as frictionally engage the shaft 16. In this case, in some embodiments of the invention, the two arms 64 are substantially resilient so as to allow an intended user to modulate the frictional force between the two arms 64 and the shaft 16. For example, and non-limitatively, a suitable example for the diameter of the recess is a diameter of from about 95 mm to about 160 mm.

Figure 7:
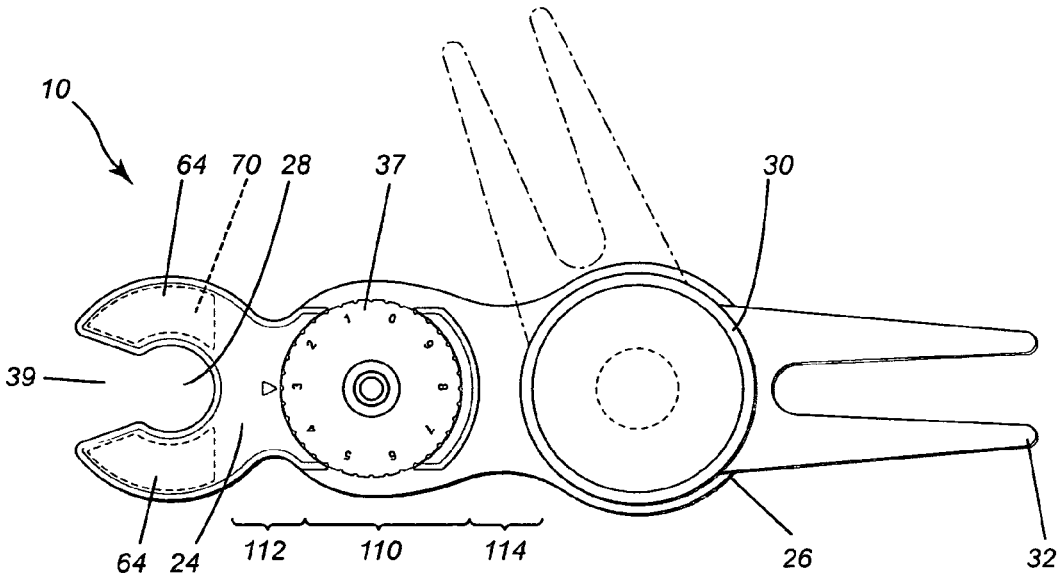
FIG. 7 is a top elevation view of the golfing accessory of FIG. 1.

As shown in FIGS. 6 and 7, the two arms 64, provided in some embodiments of the invention, with recesses 70. The recesses 70 allow manufacturing the two arms 64 using a relatively small amount of material and further allow through a variation of their dimensions to adjust the resiliency of the two arms 64.

As mentioned hereinabove, in some embodiments of the invention, the body intermediate portion 34 defines a pocket 36. Referring to FIG. 6, the body intermediate portion 34 includes a pocket base 71 and a pocket ledge 72. Pocket base 71 and the pocket ledge 72 define a pocket opening 74 therebetween allowing the member distal tip 32 to enter the pocket 36 upon the pivotal movement of the ground engaging member 30 towards the retracted configuration. The pocket ledge 72 and the pocket base 71 extend from the body first end 24 towards the body second end 26.

In some embodiments of the invention, the accessory 10 is manufactured with a body 22 including a polymer as, for example polycarbonate, and a ground engaging member 30 including, at least in part, a metal. However, it is within the scope of the invention to use any other suitable material to manufacture the accessory 10.

In a specific embodiment of the invention, the body 22 is manufactured separately from the ground engaging member 30. The ground engaging member 30 is rotatably attached to the body 22 by an insertion of the rivet 56 into the recess 48. For example, during manufacturing, the rivet 56 includes a substantially cylindrical piece of a substantially uniform cross section. Then, the rivet 56 is inserted into the aperture 48 and heat is applied to an extremity of the rivet 56. The heated bit softens the rivet 56, which flows into the aperture 48 so as to attach the ground engaging member 30 to the body 22.

The reader skilled in the art will readily appreciate that the ground engaging member 30 is attachable to the body 22 in any suitable manner, for example using a bolt and a nut, using a traditional rivet, or using any other suitable method.

To support the golf club 12 away from the ground surface 14, the accessory 10 is provided by an intended user in the extended configuration. Then, the shaft 16 of the golf club 12 is inserted through the opening 39 into the recess 28. Typically, golf club shafts 16 are substantially tapered towards the head 18. Accordingly, moving the accessory 10 towards the grip 20 with the shaft 16 inserted into the opening 28 allows frictional engagement of the shaft 16 with the two arms 64. Then, the ground engaging member 30 is inserted into the ground, which allows supporting the grip 16 away from the ground surface 14, as shown in FIG. 1.

When the intended user picks up the golf club, the frictional engagement between the two arms 64 and the shaft 18 help to ensure that the user does not forget the accessory onto the ground surface 14. Indeed, the frictional engagement if properly performed will secure the accessory 10 to the shaft 16, even when the golf club 18 is picked up from the ground.

In embodiments of the invention wherein the frictional engagement of the accessory 10 with the shaft 16 is not sufficiently strong enough to ensure that the accessory 10 remains attached to the shaft 16, the intended user is likely to notice that the accessory 10 falls onto the ground surface 14, for example through a noise produced by the accessory 10 when hitting the shaft 16 or ground surface 14, or through a visual indication caused by the movement of the accessory. In both cases, even if the intended user had forgotten that the accessory 10 was in use, it is likely that the intended user would notice that the accessory 10 has been detached from the shaft 16. Therefore, the accessory 10 is relatively hard to forget on the golf course.

Supporting the golf club 12 away from the ground surface 14 also helps the user in locating the golf club 12 when the user walks away from the location at which the golf club 12 is located. In addition, since the golf club is made more visible, risks of running a golf cart over the golf club 12 are relatively reduced.

To tighten spikes onto the sole of the user, to repair ball marks, and to clean the golf shoes, the golf shaft, and the golf club head, the accessory 10 is used in a manner that is well known in the art and that will therefore not be described in further details.

In some embodiments of the invention, the accessory 10 includes the counter 37. The counter 37 allows the intended user to mark a count. For example, the counter 37 allows the intended user to mark a count of shots performed until the golf ball enters a hole. However, it is within the scope of the invention to have counters that are suitable for marking any other count.

In some embodiments of the invention, as seen in FIG. 2, the counter 37 includes a substantially disc shaped counter member 82 rotatably mounted to the body 22. The counter member 82 is provided with numerical indicia 84 for indicating a count to mark. The body 22 includes a reference mark 86, for example an arrow, provided substantially adjacent to one of the indicia 84. The indicium 84 that is substantially adjacent to the reference mark 86 corresponds to the count to be marked.

In a specific embodiment of the invention, the pocket ledge 72 defines a ledge recess 87 for rotatably receiving at least in part therein the counter member 82. The ledge recess 87 defines a peripheral ledge recess aperture 88 for allowing the golfer to rotate the counter member 84. In some embodiments of the invention, the counter member 82 includes a plurality of protrusions 90 extending substantially radially outwardly therefrom, but these protrusions 90 are not provided in alternative embodiments of the invention.

The counter member 82 defines a counter member top surface 94 and a substantially opposed counter member bottom surface 96 (seen in FIG. 3). The counter member bottom surface 96 defines a plurality of substantially circumferentially equidistant counter recesses 98 extending substantially inwardly thereinto. The ledge recess 87 defines one or more ledge recess protrusion(s) 99 extending substantially upwardly therefrom for engaging at least one of the counter recesses 98. Although two ledge recess protrusions 99 are shown in the drawings, it within the scope of the invention to have counters including any suitable number of ledge recess protrusions.

The ledge recess protrusions 99 engage at least one of the counter recesses 98 to allow a rotation of the counter only upon a predetermined torque being exerted onto the counter member.

The counter member 82 is secured to the ledge 72 in any suitable manner. For example, the counter member 82 defines a substantially centrally located counter member aperture 97. The counter member 82 is attached within the ledge recess 87 through a rivet 101 extending integrally from the ledge recess 72 and into the counter member aperture 97. The rivet 10l is substantially similar to the rivet 56 used to secure the ground engaging member 30 to the body 22.

In some embodiments of the invention, in addition to indicating a count to mark, the reference mark 86 allows the golfer to sight the hole into which the golf ball is to be hit. In this case, the golfer simply uses the mark 86 and the opening 39 as a sight to define a general direction into which the golf ball is to be hit.

To use the counter 37, the user rotates the counter member 82 into the recess 87 so that the reference mark 86 is substantially adjacent an indicia related to the count to mark.

As seen in FIG. 2, in some embodiments of the invention, the attachment portion top surface 22 defines an attachment portion top recess 103 therein. In these embodiments, the attachment portion 30 includes an attachment magnet 102 as a marker. The attachment magnet 102 is provided within the attachment portion top recess 103 and the attachment marker 38 including a metal.

The attachment marker 38 is configured and sized to be received at least in part within the attachment portion top recess 103. The attachment magnet 102 therefore attracts the attachment marker 38. The attachment marker 38 is usable, for example, to mark a position of a golf ball onto a green.

Accordingly, the attachment marker 38 in some embodiments of the invention is of dimensions substantially similar to the dimensions of a golf ball. In addition, to help in moving the marker 38 out from the attachment portion top recess 103, in some embodiments of the invention, the attachment magnet 102 defines a detachment recess 106 (seen in FIG. 6) for receiving, at least in part, the marker 38 upon the intended user applying suitable force onto the marker 38. Such markers and recesses are well known in the art and will therefore not be described in further details.

In some embodiments of the invention, the marker 38 displays a logo related to the company that manufactures the accessory 10. In other embodiments of the invention, the marker does not display any specific logo or information. In yet other embodiments of the invention, the marker 38 displays a promotional logo related to the golf course onto which the game is played, to the sponsor of a tournament, or any other suitable logo.

In some embodiments of the invention, as better illustrated in FIG. 7, the body intermediate portion 34 defines a grasping portion provided between the body first and second ends 24 and 26. The grasping portion 34 is configured and sized to be graspable by the hand of an intended user.

For example, the grasping portion includes a grasping portion central section 110, and first and second necks 112 and 114, each provided respectively between the grasping portion central section and the body first and second ends 24 and 26. The first and second necks 112 and 114 extend in a substantially lateral direction that is substantially perpendicular to a body longitudinal direction over a distance substantially smaller than a lateral extension of the grasping portion central section 110.

In other embodiments of the invention, the grasping portion is any other suitable grasping portion. The grasping portion helps the user to properly grasp the accessory 10 to perform the actions allowed by the accessory 10.

In some embodiments of the invention, a clip (not shown in the drawings) is provided so that the accessory 10 is attachable to a belt, to a hat, or to any other suitable article of clothing worn by the golfer. Such clips are well-known in the art and the clip is therefore not further described hereinbelow.

Although the present invention has been described hereinabove by way of preferred embodiments thereof, it can be modified, without departing from the spirit and nature of the subject invention as defined in the appended claims.

What is claimed is:

1. A golfing accessory for supporting a golf club away from a ground surface, the golf club having a shaft, said accessory comprising:

a. a substantially elongated body defining a body first end and a substantially longitudinally opposed body second end;

b. said body being provided with a shaft receiving recess for receiving at least partially therein the shaft, said recess being provided substantially adjacent said body first end; and c. a ground engaging member pivotally attached to said body substantially adjacent said body second end for pivotal movement between a retracted configuration and an extended configuration, said ground engaging member defining a member distal tip for insertion at least in part into the ground; wherein in said retracted configuration, said member distal tip is substantially in register with said body, and in said extended configuration, said member distal tip extends substantially outwardly from said body, said ground engaging member including an attachment portion and a fork extending from said attachment portion, said member distal tip being defined by said fork, said attachment portion being substantially disc-shaped and defining an attachment portion top surface and a substantially opposed attachment portion bottom surface, said attachment portion defining a substantially central attachment portion aperture extending from said attachment portion top surface to said attachment portion bottom surface;

d. wherein said body defines a substantially annular attachment portion receiving recess substantially adjacent said body second end; and said attachment portion bottom surface defines a substantially annular ridge extending substantially downwardly therefrom for engaging said attachment portion receiving recess.

2. A golfing accessory as defined in claim 1, wherein said body includes a body intermediate portion provided between said body first end and said body second end, said body intermediate portion defining a pocket for receiving at least in part thereinto said member distal tip when said ground engaging member is in said retracted configuration.

3. A golfing accessory as defined in claim 2, wherein said body intermediate portion includes a pocket base and a pocket ledge spaced apart from said pocket base, said pocket base and said pocket ledge defining said pocket, said pocket base and said pocket ledge further defining a pocket opening therebetween allowing said member distal tip to enter said pocket upon a pivotal movement of said ground engaging member towards said retracted configuration, said pocket ledge and said pocket base extending from said body first end towards said body second end.

4. A golfing accessory as defined in claim 3, further comprising a counter for allowing the intended user to mark a count.

5. A golfing accessory as defined in claim 4, wherein said counter includes a substantially disc-shaped counter member rotatably mounted to said body, said counter member being provided with numerical indicia for indicating a count to mark, said body including a reference mark provided substantially adjacent to one of said indicia that corresponds to the count to mark.

6. A golfing accessory as defined in claim 5, wherein said pocket ledge defines a ledge recess for rotatably receiving at least in part therein said counter member.

7. A golfing accessory as defined in claim 6, wherein said ledge recess defines a peripheral ledge recess aperture for allowing the intended user to rotate said counter member.

8. A golfing accessory as defined in claim 7, wherein:

a. said counter member defines a counter member top surface and a substantially opposed counter member bottom surface, said counter member bottom surface defining a plurality of substantially circumferentially equidistant counter recesses extending substantially inwardly thereinto;

b. said ledge recess defines a ledge recess protrusion extending substantially upwardly therefrom for engaging at least one of said counter recesses; and c. said ledge recess protrusion engages said at least one counter recess so as to allow a rotation of said counter only upon a predetermined torque being exerted onto said counter member.

9. A golfing accessory as defined in claim 6, wherein said counter member defines a substantially centrally located counter member aperture, said counter member being attached within said ledge recess through a rivet extending integrally from said ledge recess and into said counter member aperture.

10. A golfing accessory as defined in claim 2, wherein said body intermediate portion defines a grasping portion provided between said body first and second ends, said grasping portion being configured and sized to be graspable by the hand of an intended user.

11. A golfing accessory as defined in claim 10, wherein said grasping portion includes:

a. a grasping portion central section; and b. first and second necks provided respectively between said grasping section central section and said body first and second ends;

c. said first and second necks extending in a substantially lateral direction substantially perpendicular to a body longitudinal direct over a distance substantially smaller than an extension of said grasping portion central section in the lateral direction.

12. A golfing accessory as defined in claim 1, wherein said attachment portion is attached to said body through a rivet extending integrally from said attachment portion receiving recess into said attachment portion aperture.

13. A golfing accessory as defined in claim 1, wherein said attachment portion top surface defines an attachment portion top recess therein, said attachment portion including an attachment magnet and a marker, said attachment magnet being provided within said attachment portion top recess, said attachment marker including a metal and being configured and sized to be received at least in part within said attachment portion top recess.

14. A golfing accessory as defined in claim 1, wherein said attachment portion and said body are complementary configured and sized to allow said attachment portion to pivot with respect to said body when in said retracted configuration only upon a predetermined torque being applied onto said attachment portion.

15. A golfing accessory as defined in claim 14, wherein:

a. said attachment portion bottom body surface defines an attachment portion recess extending substantially inwardly thereinto;

b. said body defines an a body protrusion extending substantially upwardly therefrom for engaging an attachment portion recess; and c. upon said attachment portion receiving recess protrusion engaging said attachment portion recess, a rotation of said attachment portion with respect to said body is allowed only upon a predetermined torque being exerted onto either one of said attachment member and said body.

16. A golfing accessory as defined in claim 1, wherein said shaft receiving recess is defined by first and second arms extending substantially longitudinally outwardly from said body, said first and second arms defining an opening therebetween leading into said shaft receiving recess.

17. A golfing accessory as defined in claim 16, wherein said opening is substantially tapered towards said recess.

18. A golfing accessory as defined in claim 17, wherein said recess is at least in part substantially tapered towards said opening.

19. A golfing accessory as defined in claim 18, wherein said opening is configured and sized to be able to engage a golf shoe spike so as to allow an intended user to screw and unscrew the spike into and out from the shoe.

* * * * *